US006691825B2

(12) United States Patent
Haig

(10) Patent No.: US 6,691,825 B2
(45) Date of Patent: Feb. 17, 2004

(54) ADJUSTABLE LADDER STABILIZER AND TOOL HOLDER

(76) Inventor: Voy Haig, 115 Mountainview Rd., Greeley, PA (US) 18425

( * ) Notice: Subject to any disclaimer, the term of this patent is extended or adjusted under 35 U.S.C. 154(b) by 0 days.

(21) Appl. No.: 10/228,227

(22) Filed: Aug. 26, 2002

(65) Prior Publication Data

US 2003/0201139 A1 Oct. 30, 2003

Related U.S. Application Data

(60) Provisional application No. 60/374,773, filed on Apr. 24, 2002.

(51) Int. Cl.[7] ..... E04G 5/02; E04G 3/00; E06C 7/06

(52) U.S. Cl. ..... 182/107; 182/214; 182/129; 248/238

(58) Field of Search ..... 182/107, 214, 182/129, 230, 120, 121, 122, 108; 248/238, 210, 211, 235

(56) References Cited

U.S. PATENT DOCUMENTS

| | | | | | |
|---|---|---|---|---|---|
| 2,327,317 | A | | 8/1943 | Randall | 228/60 |
| 2,592,006 | A | | 4/1952 | Burke | 228/60 |
| 3,072,218 | A | | 1/1963 | Peters | 182/214 |
| 3,100,026 | A | * | 8/1963 | Sunshine | 182/214 |
| 3,146,854 | A | | 9/1964 | Terwilliger | 182/120 |
| 3,288,249 | A | * | 11/1966 | Gibson | 182/214 |
| 3,336,999 | A | * | 8/1967 | McSwain | 182/214 |
| 3,568,801 | A | | 3/1971 | Werner | 182/214 |
| 3,693,756 | A | | 9/1972 | Walker et al. | 182/129 |
| 4,359,138 | A | * | 11/1982 | Kummerlin et al. | 182/214 |
| 4,469,195 | A | * | 9/1984 | Sartain | 182/206 |
| 4,502,566 | A | | 3/1985 | Wing | 182/214 |
| 4,593,790 | A | | 6/1986 | Brewer et al. | 182/214 |
| 4,615,412 | A | * | 10/1986 | Clarke | 182/214 |
| 5,113,973 | A | | 5/1992 | Southern | 182/214 |
| 5,323,875 | A | * | 6/1994 | Kennett | 182/214 |
| 5,460,241 | A | * | 10/1995 | LaBelle | 182/214 |
| 6,152,262 | A | | 11/2000 | Jung | 182/107 |
| 6,244,382 | B1 | * | 6/2001 | Labonte | 182/107 |
| 6,250,424 | B1 | * | 6/2001 | Laug | 182/107 |

* cited by examiner

*Primary Examiner*—Blair M. Johnson
*Assistant Examiner*—Hugh B. Thompson
(74) *Attorney, Agent, or Firm*—Sandra M. Kotin

(57) ABSTRACT

An attachment for a straight ladder that can stabilize the ladder when placed against vertical surfaces that include a flat wall, an inside corner and an outside corner. Adjustments permit use around a window or other such structure within the wall. A tubular framework accepts two support arms. The support arms may be arranged in several different orientations within the framework. Pivotable sleeves attached to the underside of the framework accept the support arms to stabilize the ladder when placed against a tree or column. A tension spring between the sleeves assist the support arms holding the ladder against the tree. A plate affixed to the top of the framework supports a tray with depressions and cutouts so that tools and supplies may be kept close at hand.

29 Claims, 8 Drawing Sheets

ADJUSTABLE LADDER STABILIZER AND TOOL HOLDER

This application claims the benefit of provisional application No. 60/374,773 filed Apr. 24, 2002.

FIELD OF THE INVENTION

The instant invention relates to a device for attachment to the top rungs of a ladder to stabilize the ladder against a vertical surface and maintain tools and supplies within easy reach of the user.

BACKGROUND OF THE INVENTION

Ladders placed against a wall have always posed a stability problem. The problem is more serious when the ladder must be used on a corner or near a window where there is often insufficient surface on which to support the rails. A variety of devices have been developed that have attempted to solve this problem.

In U.S. Pat. No. 2,327,317 Randall teaches a hollow frame to be attached by means of brackets to the rails of a ladder. An independent arm extends outward from each side of the hollow frame as needed. Angled portions attached to the arms make contact with the wall. A second embodiment provides straight portions extending forward from the arms at right angles. Each of the straight portions can be extended as far as needed and independent of the other so that the ladder can be stabilized against an irregular wall. This same arrangement can be used at the bottom of the ladder to stabilize it on irregular ground. The ends of the contacting parts may be pointed or have rubber feet to prevent slippage. Similar devices are taught by Werner (U.S. Pat. No. 3,568,801), Wing (U.S. Pat. No. 4,502,566) and Southern (U.S. Pat. No. 5,113,973). None of these devices can be used at corners of intersecting walls.

In U.S. Pat. No. 6,152,262, Jung discloses stabilizing bars that are stored within one hollow rung of a ladder. The bars can extend from the ladder at an angle and are composed of telescoping segments that can be locked in place to extend as far as needed. Additional supporting members can also be stored within another rung of the ladder. This invention cannot be adapted to surfaces that are not flat.

Burk teaches a U-shaped brace that is attached at the top of a ladder. The arms of the U extend forward and make contact with the wall. Rubber grips at the ends of the arms prevent slipping. A cross bar adds strength and a chain extending from the cross bar to another rung provides additional support. Sockets mounted on the inside of each arm at a 45° angle can accept additional extension arms by threading into the sockets. These extensions enable the brace to stabilize the ladder on an outside corner by gripping the wall on each side of the outside corner. (U.S. Pat. No. 2,592,006) Another U-shaped brace for use on a ladder provides additions for insertion at the end of each forward extending arm. The additions have ends that are turned inward at a 45° angle and covered with rubber sleeves for the support of the ladder on an outside corner. (Peters, U.S. Pat. No. 3,072,218) Neither of these devices are horizontally adjustable and therefore are of limited use around windows or other structures within the wall.

Brewer et al. in U.S. Pat. No. 4,593,790, disclose a foldable device to be attached to a ladder for stability. The device can be folded into several orientations so the ladder can be stabilized at an outside corner, an inside corner, an overhang and can be set to span a window. Spring loaded hinges enable the various configurations. This device is quite complex and appears cumbersome and heavy.

In U.S. Pat. No. 3,693,756, Walker et al. teach a U-shaped brace that can be attached to the top of a ladder with arms extending forward for stability against a wall and to the bottom of a ladder with arms extending downward for stability on the ground. A compartment for holding supplies can be attached to the brace as can hooks for such things as paint cans. The brace is of fixed dimensions and so is of limited use. Terwilliger (U.S. Pat. No. 3,146,854) discloses a ladder positioning attachment that consists of an upper plate and a lower plate with a centralized separator in between. The plates extend forward of and beyond the sides of the ladder. The portion of the attachment that lies between the rails is bolted to a rung. On each side of the device a leg is pivotally attached between the plates. There are several holes through the upper plate and another hole in each leg. The legs can be moved into several positions and set in place by inserting a fastener through the selected hole in the plate and the hole in the leg. As the angle of the legs change, so does the distance of the upper part of the ladder from the wall. Tools or other objects can be set on the flat upper plate. This device is only usable against a flat wall.

None of the prior art devices provide stability for a ladder at all wall variations and also provide means to hold tools and supplies. None of the prior art provides a means to keep small objects such as nails and screws close at hand and easy to reach. And none of the prior art patents teach the technology that will enable a ladder to be stabilized against a column or tree. There is a need for a device that can be attached to the top of any ladder and accomplish all of these tasks.

BRIEF SUMMARY OF THE INVENTION

The present invention provides a stabilizing means for attachment to a ladder to enable the ladder to be set securely against a variety of vertical surfaces and also provides means to hold numerous tools and supplies within easy reach.

It is an object of the present invention to provide a stabilizer that can be easily and securely attached to any straight ladder.

It is another object of the present invention to provide a stabilizer for ladders that prevents the ladder from slipping once set in place whether against a flat wall or corner.

A further object of the present invention is to provide a stabilizer for ladders that can be used against most vertical surfaces and can span various structural variations such as windows and corners.

A still further object of the present invention is to provide a stabilizer for ladders that can hold a ladder securely against a tree or column.

Another object of the present invention is to provide a stabilizer that can also hold tools and supplies, including small objects such as screws and nails, so they are within easy reach.

A further object of the present invention is to provide a stabilizer that can quickly and easily be adapted from one type of vertical surface to another.

A still further object of the present invention is to provide a stabilizer that is inexpensive to manufacture and can be manufactured using readily available materials.

Another object of the present invention is to provide a stabilizer that can be quickly fastened securely to the ladder and can easily be removed therefrom A still further object of the present invention is to provide a stabilizer with parts that fit within the framework for compact storage and easy transport.

The instant invention is a stabilizer for supporting a ladder of a type having parallel side rails and a series of transverse rungs set at regular intervals therebetween against a substantially vertical surface. The stabilizer comprises a tubular frame comprising a first rearward frame member fixedly attached longitudinally to a second forward frame member, and two angled frame members affixed near the center of the forward frame member at opposing acute angles thereto and lying in the same plane with the first and second frame members. There are two sleeves pivotally attached to the underside of the frame with a tension spring connecting the two sleeves. Two support arms, a rearward support arm and a forward support arm, are dimensioned to fit slidably and reversibly within the first frame member, the second frame member, the angled frame members and the sleeves. Each support arm is bent to form a leg extending at a right angle therefrom. Attachment means are affixed to the tubular frame for reversibly attaching the stabilizer to the ladder.

Other features and advantages of the invention will be seen from the following description and drawings.

DETAILED DESCRIPTION OF THE INVENTION

Figure 1:
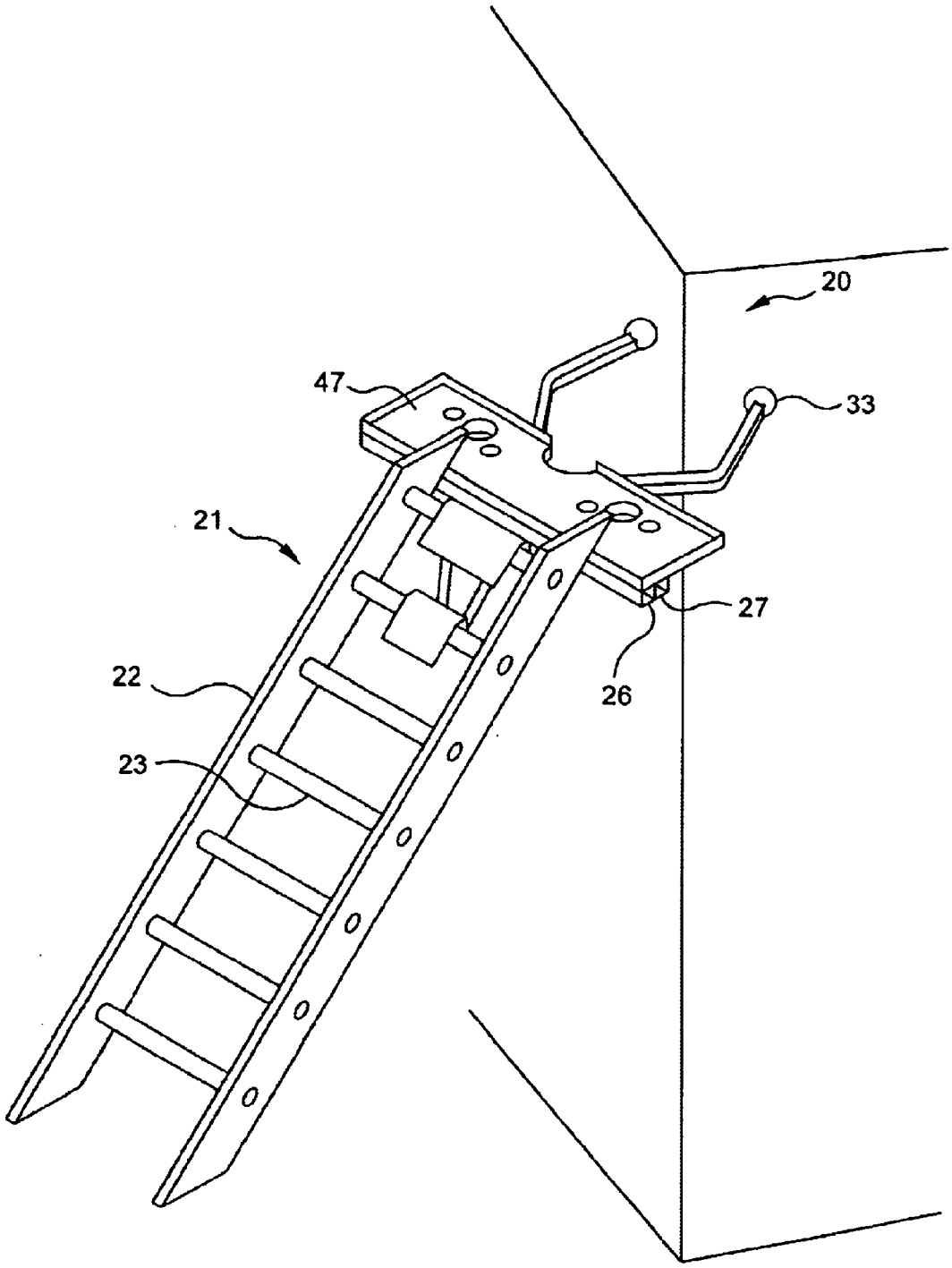
FIG. 1 is a perspective view of a ladder with the stabilizer of the instant invention attached to the two top rungs.
Figure 3:
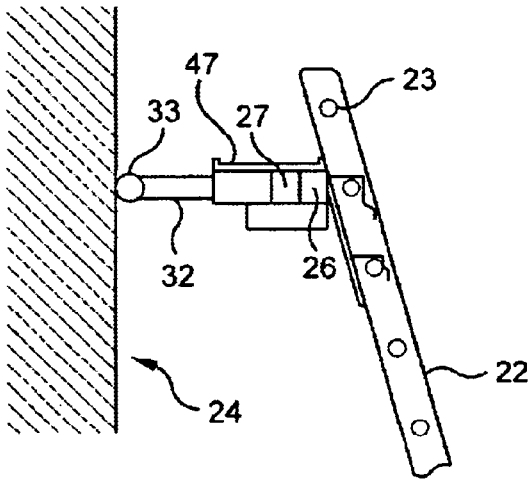
FIG. 3 is a side sectional view of the stabilizer through line 3—3 of FIG. 2.

The ladder stabilizer 20 of the instant invention may be seen in use in FIGS. 1 and 3. There may be a frame 25 composed of rigid tubular material that may be square or rectangular in cross section and may form the body and main support of the stabilizer 20. The frame 25 may be composed of four lengths of the tubular material. There may be a rearward frame member 26 and forward frame member 27, of equal length, which may be joined together longitudinally and extend a substantial distance beyond the rails 22 on each side of the ladder 21. Two additional short frame members 29 may be affixed to the forward frame member 27 at 45° angles to form a broad V shape. The short frame members 29 may not be centered on the forward frame member 27. All of the frame members may lie in the same plane. The rearward frame member 26 and the forward frame member 27 may have a series of communicating apertures 28 through their upper and lower surfaces. The apertures 28 may be disposed beginning at one end and continuing to a point beyond the center in the rearward frame member 26 and beginning at the opposing end and continuing to a point beyond the center in the forward frame member 27.

Figure 2:
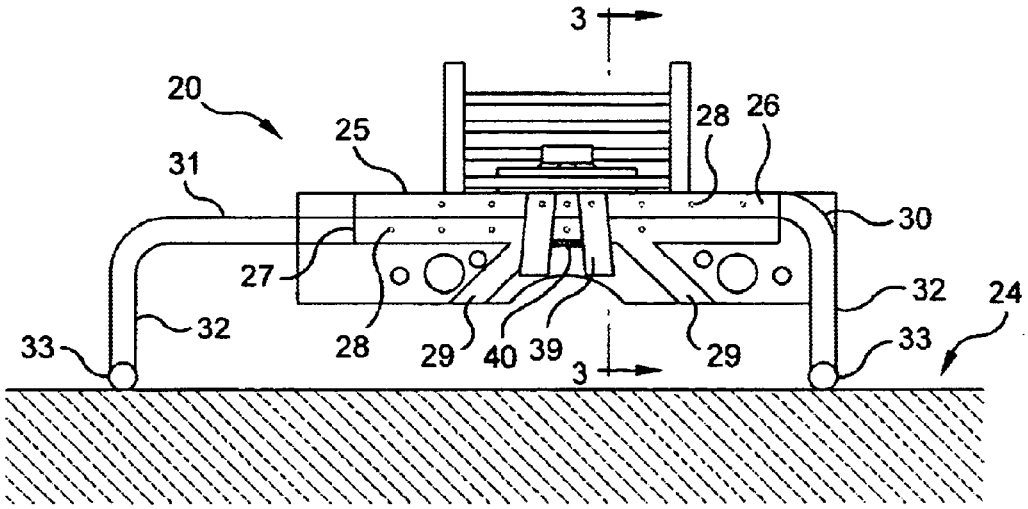
FIG. 2 is bottom plan view of the stabilizer attached to a ladder and supported against a flat wall.
Figure 5:
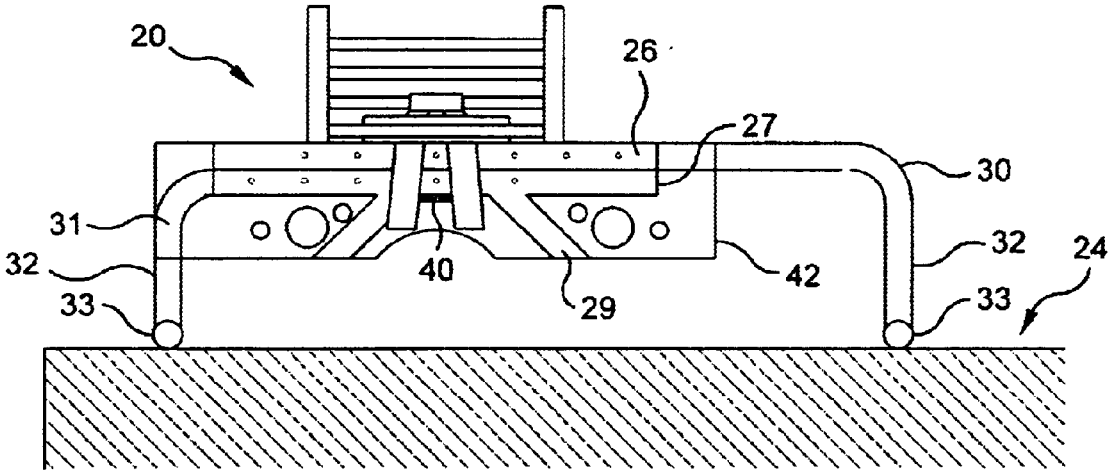
FIG. 5 is a bottom plan view of the stabilizer with the support arms in opposing extensions to the view shown in FIG. 2.

There may be two support arms, a rearward support arm 30 and a forward support arm 31 which may be composed of rigid tubular material that is dimensioned to fit easily within the frame members. The rearward support arm 30 may be slidably and reversibly disposed within the rearward frame member 26 and the forward support arm 31 may be slidably and reversibly disposed within the forward frame member 27. Each of the support arms may be bent at a right angle near one end to form a forward extending leg 32. The length of the leg for each support member may be different to compensate for the different positions of the frame members 26 and 27 and so that the stabilizer is parallel to a wall when properly positioned. (FIGS. 2 and 5). Therefore, the leg of the rearward support arm 30 may be longer than the leg of the forward support arm 31. The off center placement of the short frame members 29 may also accommodate the different lengths of the legs 32.

Figure 4:
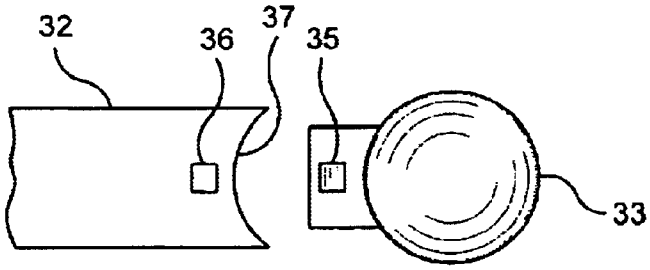
FIG. 4 is a close up side plan view of the end of a support arm and the slip resistant contact foot.

There may be a spherical foot 33 at the end of each leg. Each foot 33 may be covered with a skid resistant material or may be composed of a skid resistant material to prevent slippage of the stabilizer 20 and in turn the ladder 21 once they are properly positioned. Each foot 33 may have a collar 35 with a protruding button. The foot 33, collar 35 and button may be composed of the same material and may be of unified construction The material may also be non-marking. The collar 35 may be dimensioned to fit within the end 37 of the leg 32 which may also be curved to receive the spherical foot 33. There may be an opening 36 near the end 37 of the leg to receive the button and retain the foot 33 securely in place. These structures may be seen in FIG. 4. There may be an aperture 34 through the opposing end of each support arm 30 and 31. The support arms 30 and 31 may be inserted into their respective frame members 26 and 27 as far as desired until the apertures 34 in the ends of the support arms 30 and 31 communicate with the apertures 28 in the frame members 26 and 27. A connecting pin 38 may be inserted through the apertures 28 and 34 to hold each of the support arms 30 and 31 securely place. Adjustments in width of the support base may easily be made by removing a connecting pin 38, sliding a support arm to a new position and reinserting the connecting pin 38.

Figure 7:
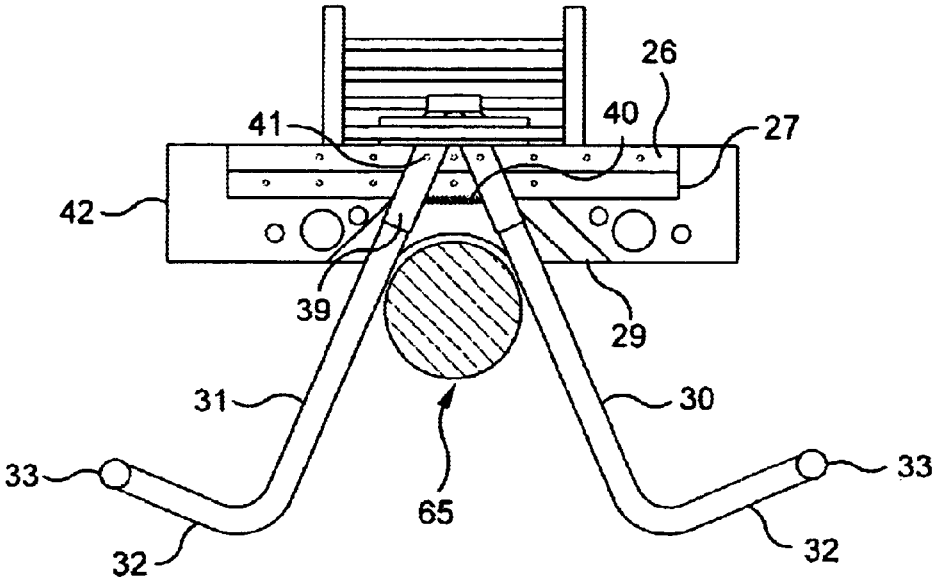
FIG. 7 is bottom plan view of the stabilizer with the arms in position for support against a tree trunk.

There may be two sleeves 39 each attached at one of its ends to the center of the underside of the rearward frame member 26 by pivot pins 41. A tension spring 40 may connect the two sleeves 39 near the opposing ends. The sleeves 39 may be dimensioned to reversibly contain the support arms 30 and 31. See FIG. 7.

Figure 9:
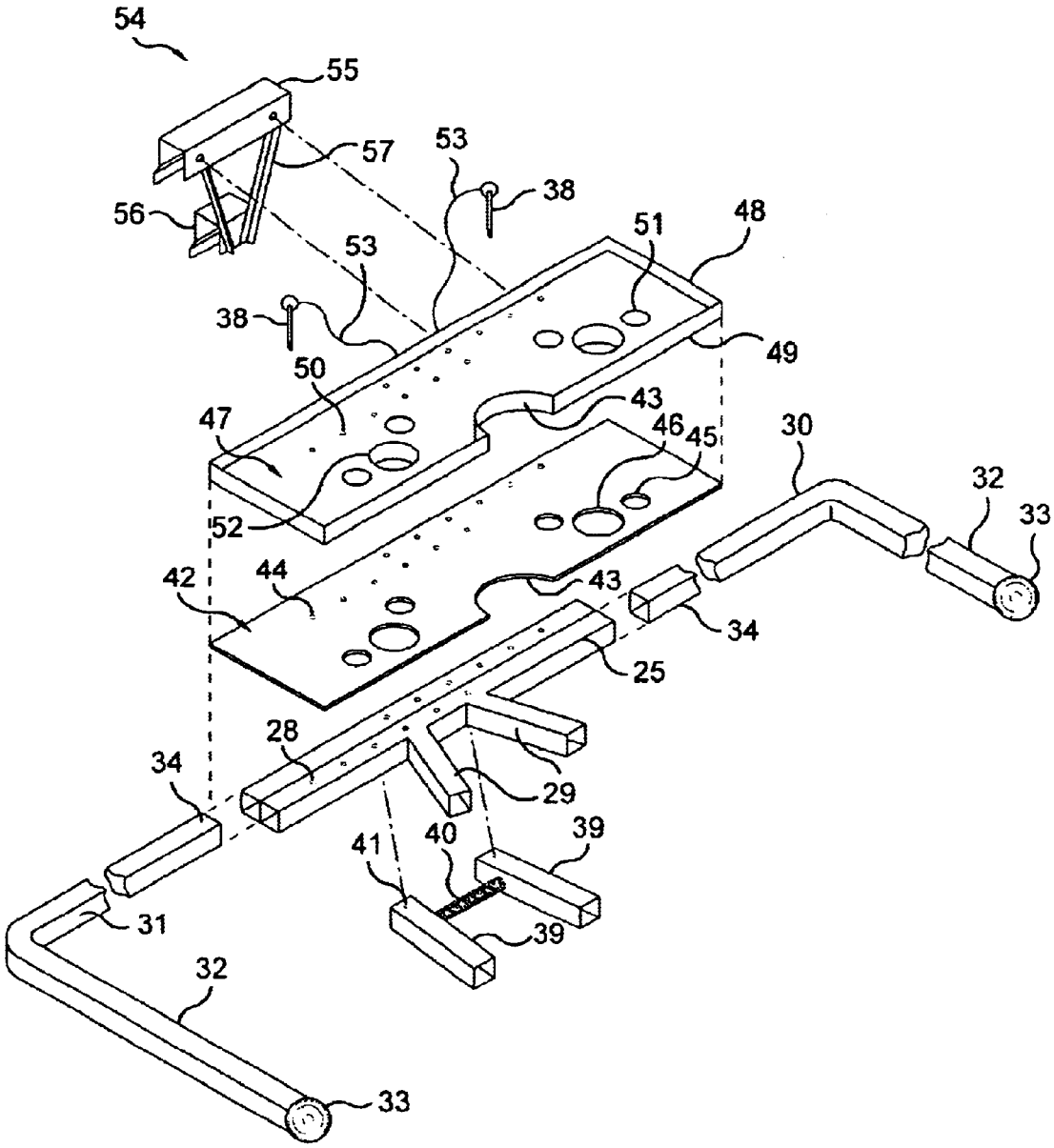
FIG. 9 is an exploded view of the stabilizer.

A substantially rectangular top plate 42 may be affixed to the upper surface of the frame 25 such that the rear edge of the plate 42 may be aligned with the rear edge of the rearward frame member 26 and the plate 42 may be longitudinally centered on the frame 25. There may be a concavity 43 centered on the forward edge of the plate 42. Two lines of openings 44 may be disposed along the rear of the plate 42 positioned to communicate with the apertures 28 in the frame members 26 and 27 and dimensioned to receive the connecting pins 38 used to secure the support arms 30 and 31 in place. There may be small cutouts 45 in the surface of the plate 42 where tools such as hammers and pliers may be placed for easy access. Larger cutouts 46 may be used to receive containers for small objects such as screws and nails. These may be seen in FIG. 9. The cutouts 45 and 46 may be positioned such that they do not lie above any of the frame members.

A removable tray 47 may be placed on top of the plate 42 and maybe substantially the same shape as the plate 42 with the same concavity 43 in the front edge. There may be a raised edge 48 about the entire circumference of the tray 47 as well as a full apron 49 which conceals the frame when the stabilizer 20 is viewed from the top or side. There may be two rows of openings 50 along the rear edge of the tray 47 communicating with the openings 44 in the plate 42 and the apertures 28 in the frame 25. Small cutouts 51 in the tray 47 may communicate with the small cutouts 45 in the plate 42 for placement of tools, and depressions 52 in the surface of the tray 47 may fit into the large cutouts 46 in the plate 42 and may serve as receptacles for small articles such as screws or nails. The raised edge 48 may prevent any objects placed on the tray from rolling off. The connecting pins 38 used to maintain the support arms 30 and 31 in place may be attached to the tray 47 by chains 53 or other type of flexible connectors that may be long enough so the connecting pins 38 may reach all of the openings 44 and may guarantee that the connecting pins 38 cannot be misplaced.

Figure 16:
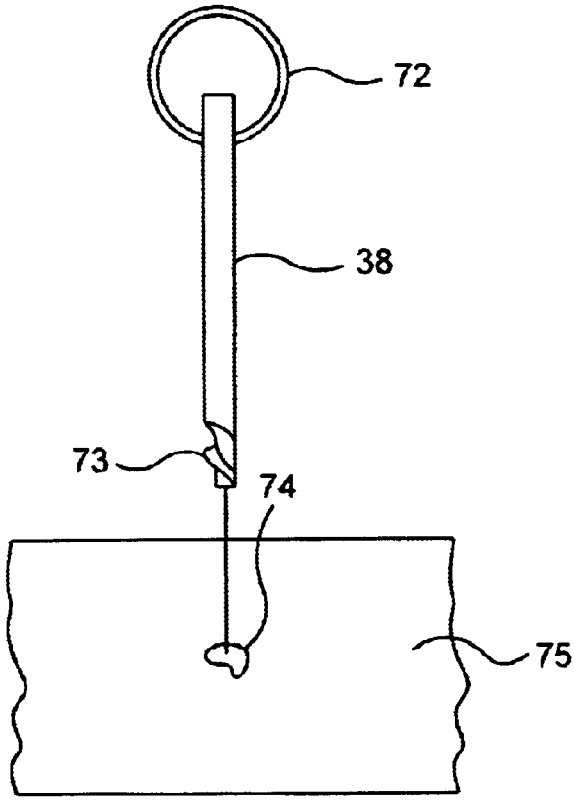
FIG. 16 is an exploded view of the connecting pin and opening in the plate.
Figure 17:
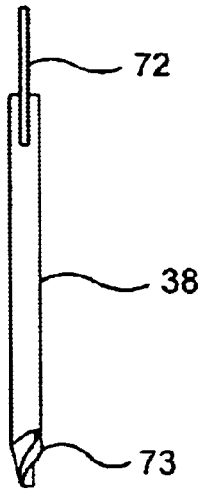
FIG. 17 is a side plan view of the connecting pin of FIG. 16 rotated 90°.

The connecting pins 38 may have rings 72 attached to their top ends to which the chains 53 or other such flexible connectors may be attached and there may also be threads 73 at their bottom ends. The tray 47, plate 42, rearward frame member 26 and forward frame member 27 may all have communicating openings to receive the connecting pins 38, as noted above. However, there may be specially shaped openings 74 in the bottom walls 75 of the rearward frame member 26 and forward frame member 27. These shaped openings 74 may be sized and dimensioned to receive the threaded ends 73 of the connecting pins 38 so that when a connecting pin 38 is given a turn, it may become locked in place. This may also insure that once a connecting pin 38 is placed into the openings through the tray 47, the plate 42 and the rearward frame member 26 or the forward frame member 27, and the support arms 30 and 31 and locked into the openings 74 in the bottom walls 75 of the frames, the support arms 30 and 31 cannot become dislodged. The ring 72 at the top of each connecting pin 38 may be used to attach the chains 53 to the connecting pins 38 and may also act as a handle to assist in locking the connecting pins 38 securely in the shaped openings 74. These features may be seen in FIGS. 16 and 17.

The stabilizer 20 may be attached to the ladder 21 by a first ladder fastener 54 which may be composed of two inverted U-shaped clips, an upper clip 55 and a lower clip 56, which are spaced apart to fit over any two consecutive rungs 23 of the ladder 21. The upper clip 55 may be substantially the width of the rungs 23 while the lower clip 56 may be considerably narrower. The clips 55 and 56 may be connected to each other by two struts 57 which are angled to form a "V". The fastener 54 may be attached to the stabilizer frame 25 by permanently affixing the forward surface of the upper clip 55 to the center of the rear face of the rearward frame member 26. The clips 55 and 56 may each have one vertical side 58, the front of the clip, and one stepped side 59, the rear of the clip, and a flat top portion 60. The stepped side 59 may protrude outward in graduated steps so that the first ladder fastener 54 may be securely seated over rungs of different shapes and diameters, thus permitting the stabilizer to be used with many different ladders.

Figure 10:
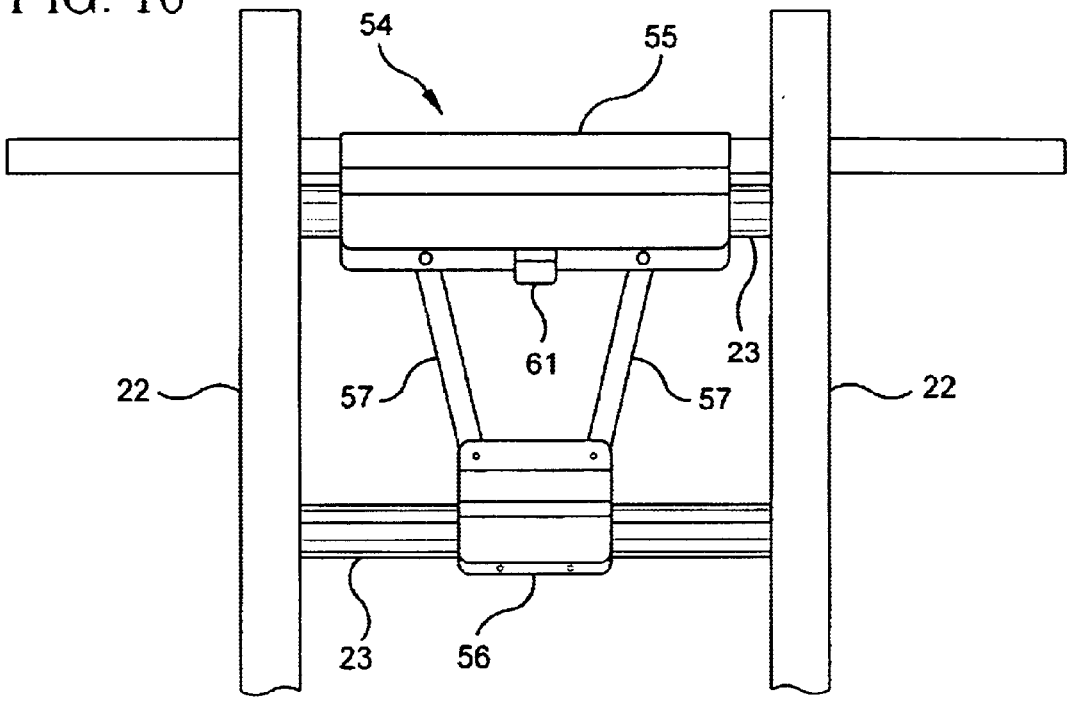
FIG. 10 is rear plan view of the first ladder fastener.
Figure 11:
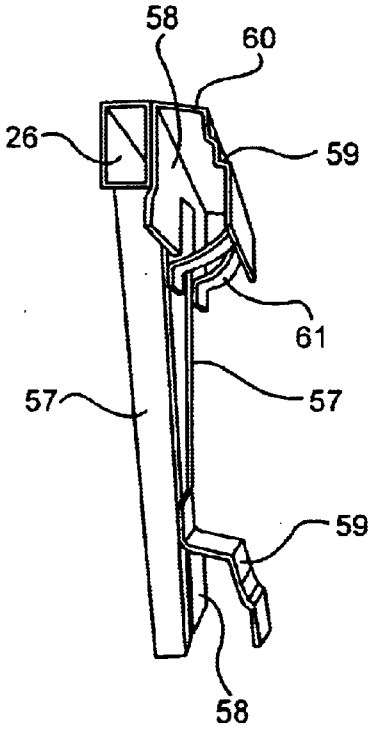
FIG. 11 is a side perspective view of the first ladder fastener.
Figure 12:
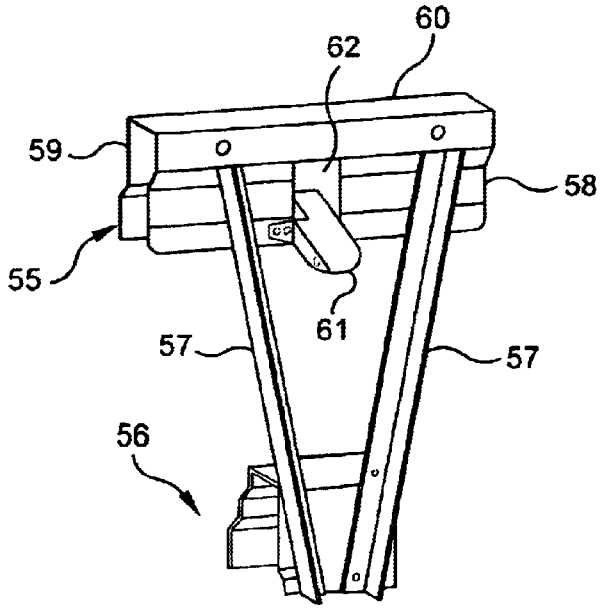
FIG. 12 is a front perspective view of the first ladder fastener.

A spring loaded catch 61 may be pivotally attached to the center near the bottom edge of the stepped side 59 of the upper fastening clip 55. There may also be an opening 62 above the catch 61 to provide room for the catch 61 to pivot upward and make contact with the rung 23 of the ladder 21. The first ladder fastener 54 may be attached to any two consecutive rungs of the ladder 21. See FIGS. 10, 11 and 12.

Figure 13:
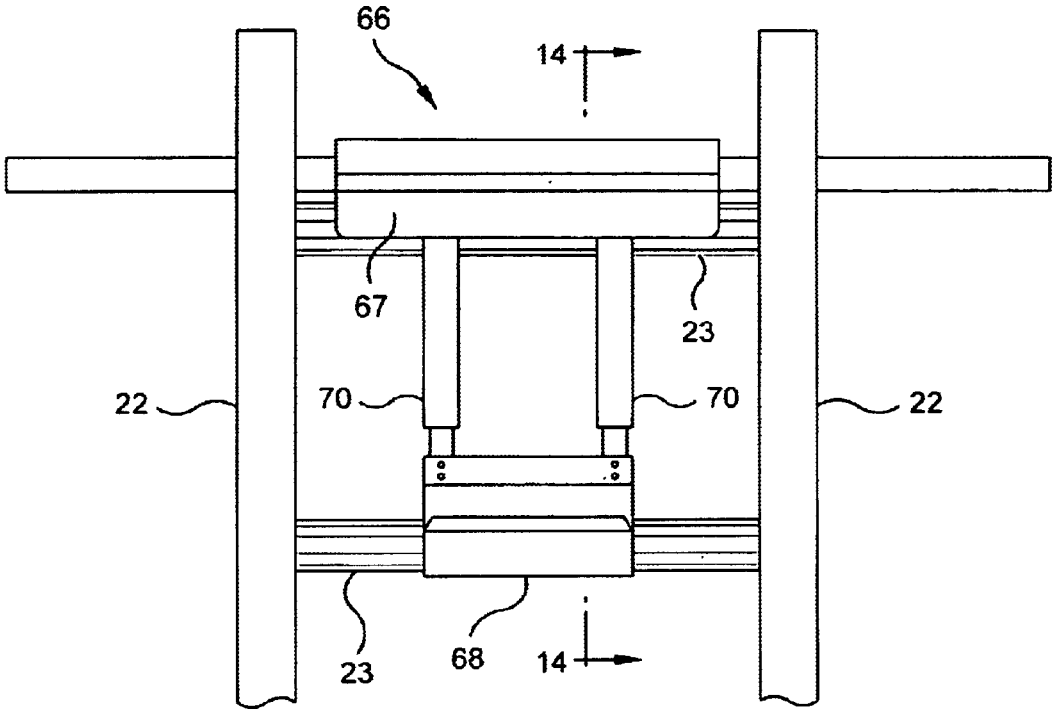
FIG. 13 is a rear plan view of the second form of the ladder fastener.
Figure 14:
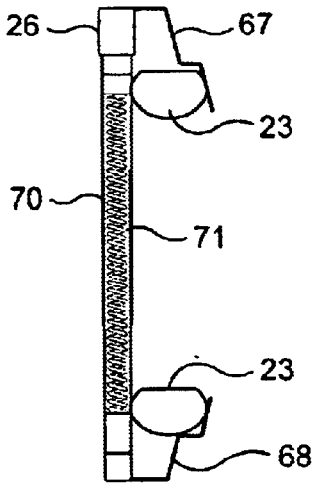
FIG. 14 is a sectional view through line 14—14 of the ladder fastener of FIG. 13.
Figure 15:
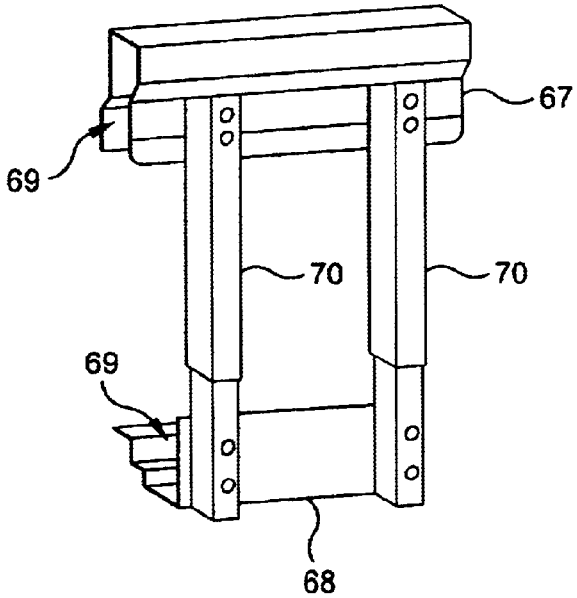
FIG. 15 is a front perspective view of the ladder fastener of FIG. 13.

There may be a second ladder fastener 66 that may be used for all straight ladders regardless of the spacing between the rungs. The second ladder fastener 66 may be used with ladders built to metric standards as well as U.S. standards. There may be two U-shaped clips, an upper clip 67 and a lower clip 68 having the same configurations and relative sizes as in the first ladder fastener 54 described above and which may also be used with rungs of varying shapes and diameters. However, in the second ladder fastener 66 the upper clip 67 may be inverted and the lower clip 68 may not be inverted such that the openings 69 in the two clips are facing each other. The forward surface of the upper clip 67 may be permanently attached to the stabilizer frame 25 at the center of the rear face of the rearward frame member 26 in the same manner as the first ladder fastener 54. The upper clip 67 and lower clip 68 may be connected to each other by two struts 70 that may be parallel to each other. Each strut 70 may be composed of two tubular sections that slidably fit one within the other. There may be a tension spring 71 within the two sections that may enable the second ladder fastener 66 to be tightly seated around any two consecutive rungs of the ladder. See FIGS. 13, 14, and 15. In use the two clips 67 and 68 may be manually pulled apart expanding the struts 70 so that the clips 67 and 68 may be seated about the two consecutive rungs. Thereafter, the tension on the clips 67 and 68 may be released so that the struts 70 contract and hold the rungs securely.

The stabilizer 20 of the instant invention may be easily adapted to stabilize a ladder against a variety of vertical surfaces. When used against a flat wall 24 the support arms 30 and 31 may be inserted into the rearward frame member 26 and forward frame member 27 respectively as far as necessary and retained in place using the connecting pins 38. The stabilizer 20 may be adjusted for use near or around a window or other structure within a flat wall 24 by extending the support arms 30 and 31 outwardly or inserting the support arms 30 and 31 further into the frame members 26 and 27. FIG. 2 may show the stabilizer 20 against a flat wall 24 with the forward support arm 31 in an extended orientation and the rearward support arm 30 in its fully inserted orientation while FIG. 5 may show the support arms 30 and 31 in the opposite orientations. Such selections may be determined by the surface on which the ladder 21 is placed or structures on or within the wall 24.

Figure 6:
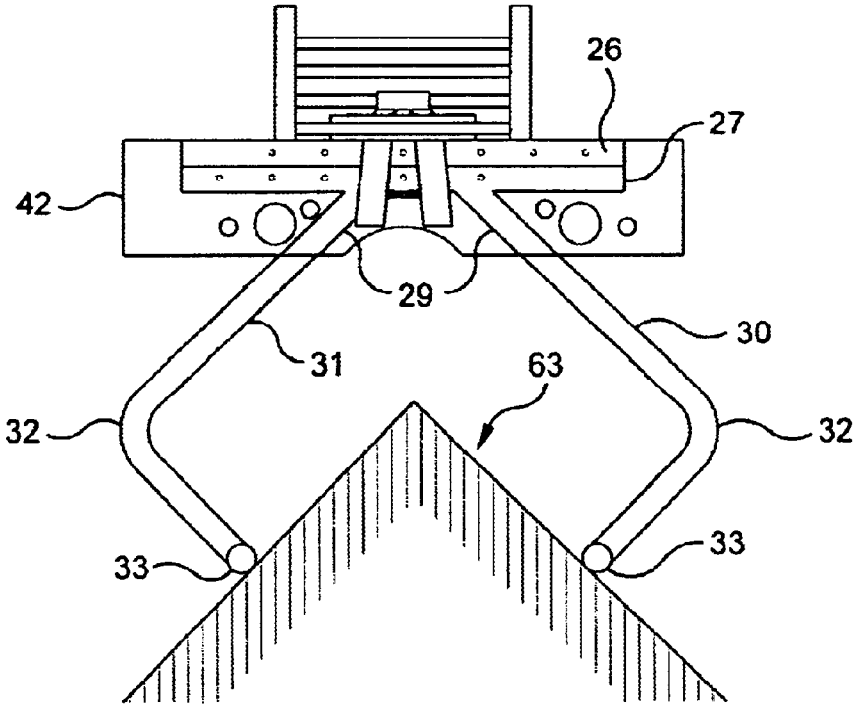
FIG. 6 is a bottom plan view of the stabilizer with the arms in position for support against an outside corner.
Figure 8:
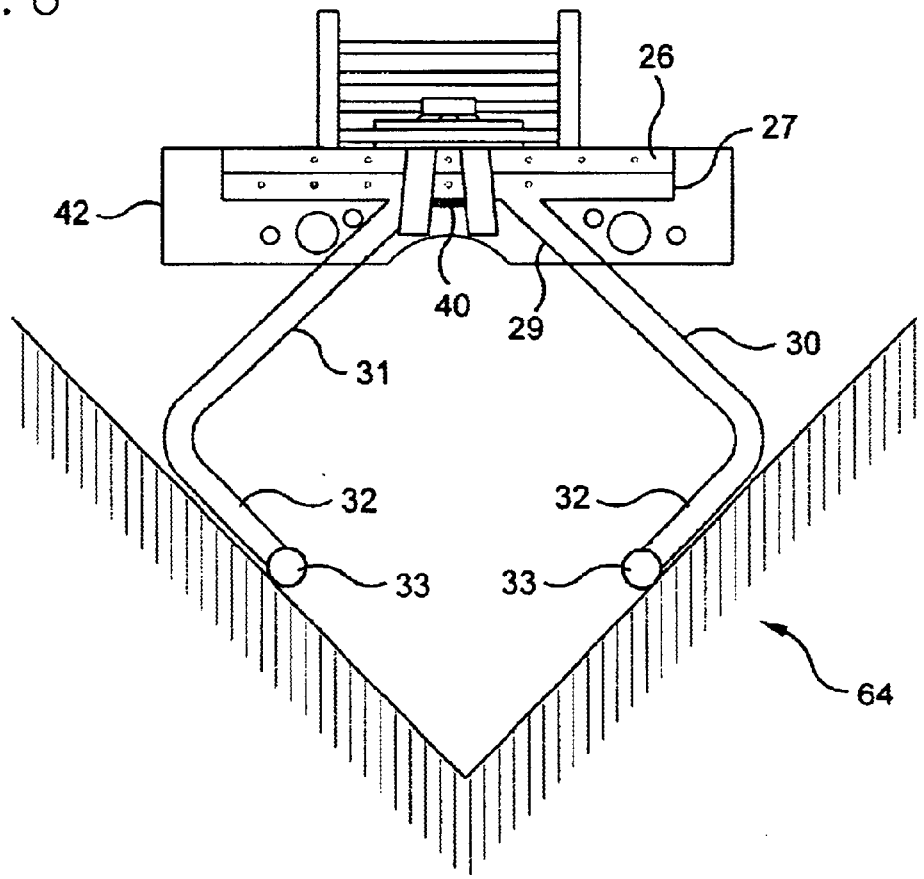
FIG. 8 is bottom plan view of the stabilizer with the arms in position for support against an inside corner.

When a ladder 21 must be supported against a corner the support arms 30 and 31 may be removed from the rearward frame member 26 and forward frame member 27 by removing the connecting pins 38 and sliding the support arms 30 and 31 outward. The support arms 30 and 31 may then be positioned within the short frame members 29. When the ladder is to be set against an outside corner 63 the support arms 30 and 31 may be positioned within the short frame members 29 so that the legs 32 may be turned inward and the feet 33 rest against the walls as shown in FIG. 6. When the ladder is to be set against an inside corner 64 the support arms 30 and 31 may be positioned within the short frame members 29 so the legs 32 may be turned inward and the sides of the legs 32 may rest against the walls as seen in FIG. 8.

A unique feature of the stabilizer 20 enables a ladder 21 to be stabilized when it must be supported against a tree, structural column, or utility pole. For this use the support arms may be positioned within the two sleeves 39 with the legs 32 turned outward. The stabilizer 20 may rest directly against a tree 65 which may fit within the concavities 43 in the front edges of the plate 42 and in the tray 47. The support arms 30 and 31 may grip the tree 65 because of the pivotability of the sleeves 39 and the tension exerted by the tension spring 40 connecting them. This may be seen in FIG. 7.

The various parts of the instant invention may be made of aluminum which may provide strength while minimizing weight. Other strong rigid materials may also be used. Square tubing is preferable for the frame, sleeves and support arms, though tubing that is rectangular in cross section or otherwise shaped may be acceptable. The tray may be made of a moldable plastic or other polymeric material for ease of manufacture. The feet may be made of a form of rubber or other polymeric material that is non-marking.

The tray of the preferred embodiment may be 90 cm wide and 16 cm deep. The support arms may be 50 cm long and the leg of the rearward support arm may extend forward 30 cm and the leg of the forward support arm may extend forward 23 cm. Depending on the position of the support arms, the support base of the stabilizer may extend from 90 cm to 150 cm and so may be able to span obstacles of considerable width.

While one embodiment of the present invention has been illustrated and described in detail, it is to be understood that this invention is not limited thereto and may be otherwise practiced within the scope of the following claims.

HAIG PARTS LIST

20 LADDER STABILIZER
21 LADDER
22 SIDE RAIL OF LADDER
23 RUNG OF LADDER
24 WALL
25 FRAME
26 REARWARD FRAME MEMBER
27 FORWARD FRAME MEMBER
28 APERTURES IN FRAME
29 SHORT FRAME MEMBERS
30 REARWARD SUPPORT ARM
31 FORWARD SUPPORT ARM
32 LEG
33 FOOT
34 APERTURE IN SUPPORT ARM
35 COLLAR
36 CUTOUT
37 CURVED END OF FOOT
38 CONNECTING PIN
39 SLEEVE
40 TENSION SPRING
41 PIVOT PINS
42 PLATE
43 CONCAVITY IN PLATE EDGE
44 OPENINGS IN PLATE FOR PINS
45 SMALL CUT OUT FOR TOOL
46 LARGE CUT OUT FOR DISH
47 TRAY
48 RAISED EDGE ON TRAY
49 APRON ON TRAY
50 OPENINGS IN TRAY FOR DOWELS
51 CUTOUT
52 DEPRESSION
53 CHAINS TO HOLD DOWELS
54 LADDER FASTENER
55 FASTENING CLIP UPPER
56 FASTENING CLIP LOWER
57 STRUT
58 VERTICAL SIDE
59 STEPPED SIDE
60 FLAT TOP
61 SPRING LOADED CATCH
62 OPENING FOR CATCH
63 OUTSIDE CORNER
64 INSIDE CORNER
65 TREE
66 SECOND LADDER FASTENER
67 UPPER CLIP
68 LOWER CLIP
69 OPENING IN CLIP
70 STRUTS
71 SPRING
72 RING ON CONNECTING PIN
73 THREADED END OF PIN
74 SHAPED OPENING FOR PIN
75 BOTTOM WALL OF FRAME

I claim:

1. A stabilizer for supporting a ladder having parallel side rails and a series of transverse rungs set at regular intervals therebetween against a substantially vertical surface, said stabilizer comprising:

a tubular frame comprising a first rearward frame member fixedly attached longitudinally to a second forward frame member, and two angled frame members affixed near the center of the second forward frame member at opposing acute angles thereto and lying in the same plane with the first and second frame members;

two sleeves pivotally attached to the underside of the frame;

a tension spring connecting the two sleeves;

a rearward support arm and a forward support arm, adapted to fit slidably and reversibly within the first frame member, the second frame member, the angled frame members, or the sleeves, each of the support arms being bent to form a leg extending at a right angle therefrom; and attachment means affixed to the tubular frame for reversibly attaching the stabilizer to the ladder;

whereby the support arms can be inserted, respectively, into the first and second frame members to stabilize the ladder in a first position, respectively into the angled frame members to stabilize the ladder in a second position, and, respectively, into the sleeves to stabilize the ladder in a third position.

2. The stabilizer as in claim 1 wherein the length of the leg of the rearward support arm is longer than the length of the leg of the forward support arm such that the frame is maintained parallel to a wall when the stabilizer is supporting the ladder against the wall.

3. The stabilizer as in claim 1 further comprising a contact foot at the end of each leg.

4. The stabilizer as in claim 3 wherein each foot is spherical.

5. The stabilizer as in claim 3 wherein each foot is composed of a slip resistant and non-marking material.

6. The stabilizer as in claim 3 wherein each foot is reversibly attached to each leg.

7. The stabilizer as in claim 1 further comprising a plate fixedly attached to an upper surface of the frame, and being larger than the frame and being flush with the frame along a rear edge thereof.

8. The stabilizer as in claim 7 further comprising a tray adapted to fit over the plate, said tray having a raised edge about the perimeter thereof and an apron about the perimeter thereof, said apron overlaying the frame and serving to hold the tray securely in place on the plate.

9. The stabilizer as in claim 1 further comprising a series of openings disposed along top surfaces and bottom surfaces of the first and second frame members, a set of openings through an inside end of each support arm, and connecting pins, whereby when a respective one of the arms is inserted into a respective one of the frame members and the openings in the inside end of the support arm are alignable with the openings in the frame member, and a connecting pin is placed therethrough, the support arm is fixed such that it cannot move laterally, and when the connecting pin is removed the support arm can be moved laterally to another position or removed from the frame member.

10. The stabilizer as in claim 9 wherein the connecting pins further comprise threads along a bottom end thereof.

11. The stabilizer as in claim 10 wherein the openings in the bottom surfaces of the first and second frame members reversibly and securely receive the threads of the respective connecting pins.

12. The stabilizer as in claim 9 wherein the connecting pins further comprise a ring fixedly attached to a top thereof.

13. The stabilizer as in claim 9 further comprising a plate fixedly attached to an upper surface of the frame, and being larger than the frame and being flush with the frame along a rear edge thereof.

14. The stabilizer as in claim 13 further comprising two series of openings in the plate near the rear edge thereof, said openings corresponding to and alignable with the openings in the first and second frame members.

15. The stabilizer as in claim 14 further comprising a tray adapted to fit over the plate, said tray having a raised edge about the perimeter thereof, an apron about the perimeter thereof, said apron overlaying the frame and serving to hold the tray securely in place on the plate, and two series of openings in the plate near the rear edge thereof, said openings corresponding to and alignable with the openings in the plate.

16. The stabilizer as in claim 13 further comprising a access substantially centered in a forward edge of the plate.

17. The stabilizer as in claim 13 further comprising at least one small cutout in the plate at a point that is not above one of the frame members such that a tool may be reversibly placed therein.

18. The stabilizer as in claim 13 further comprising at least one large cutout in the plate at a point that is not above one of the frame members such that a container for small objects may be retained therein.

19. The stabilizer as in claim 9 further comprising a plate fixedly attached to an upper surface of the frame, being larger than the frame, being flush with the frame along a rear edge, a series of openings in the plate corresponding to and alignable with the openings in the first and second frame members, a access substantially centered in the forward edge of the plate, at least one small cutout in the plate at a point that is not above one of the frame members such that a tool may be reversibly placed therein, and at least one large cutout in the plate at a point that is not above one of the frame members such that a container for small objects may be retained therein.

20. The stabilizer as in claim 19 further comprising a tray, adapted to fit over said plate and having a series of openings corresponding to and alignable with the openings in the plate, a second access corresponding to the access in the plate, at least one small cutout communicating with the small cutout in the plate and at least one depression positioned and dimensioned to cooperate with the large cutout in the plate, said depression for the containment of small objects.

21. The stabilizer as in claim 20 further comprising a raised edge about the perimeter of the tray.

22. The stabilizer as in claim 20 further comprising an apron around the perimeter of the tray, said apron overlaying the frame and serving to hold the tray securely in place on the plate.

23. The stabilizer as in claim 20 further comprising flexible connector means for the attachment of the connecting pins to the tray, said flexible connector means being long enough to enable the connecting pins to reach all of the openings.

24. The stabilizer as in claim 1 wherein the attachment means comprises a first upper inverted U-shaped member and a second lower inverted U-shaped member, each U-shaped member having a forward vertical wall, a rearward stepped wall and a substantially flat connecting surface; at least one strut in engagement with forward surfaces of the two U-shaped members for supporting and spacing the U-shaped members such that the two U-shaped members are adapted to fit over consecutive rungs of the ladder.

25. The stabilizer as in claim 24 wherein there are two struts which form a V.

26. The stabilizer as in claim 24 wherein the first U-shaped member is substantially wider than the second U-shaped member.

27. The stabilizer as in claim 24 further comprising a spring loaded catch pivotally affixed to a bottom center of the rearward stepped wall of the first U-shaped member and a cutout above the catch to enable the catch to pivot upward.

28. The stabilizer as in claim 1 wherein the attachment means comprises a first upper inverted U-shaped member and a second lower U-shaped member, each U-shaped member having a forward vertical wall, a rearward stepped wall and a substantially flat connecting surface; at least one strut in engagement with forward surfaces of the two U-shaped members for supporting and spacing the U-shaped members such that the two U-shaped members are adapted to fit over consecutive rungs of the ladder.

29. The stabilizer as in claim 28 wherein the at least one strut further comprises two tubular slidably nested segments and a tension spring disposed within the two segments whereby when the strut is extended the two U-shaped members can be placed about two consecutive rungs of the ladder, and when the strut is released the spring causes the strut to be compressed and the attachment means is adapted to hold the stabilizer securely on the rungs of the ladder.

* * * * *